US005697138A

United States Patent [19]

Swanson et al.

[11] Patent Number: 5,697,138

[45] Date of Patent: Dec. 16, 1997

[54] APPARATUS AND METHOD FOR FABRICATING TRIMMED LETTERS

[75] Inventors: Jerome Swanson, Cannon Falls; David Schmitt, Hastings, both of Minn.

[73] Assignee: Gemini, Inc., Cannon Falls, Minn.

[21] Appl. No.: 598,501

[22] Filed: Feb. 8, 1996

[51] Int. Cl.[6] ..... B21B 15/00

[52] U.S. Cl. ..... 29/335; 29/33 Q; 29/33 R; 29/566; 72/379.6; 72/404; 72/447

[58] Field of Search ..... 29/33 R, 33 Q, 29/33 S, 56.5, 56.6, 564.6, 564.7; 72/339, 404, 405.02, 419, 379.6, 447

[56] References Cited

U.S. PATENT DOCUMENTS

| | | | |
|---|---|---|---|
| 2,389,738 | 11/1945 | Olney | 72/419 |
| 2,883,893 | 4/1959 | Bloxham et al. | 29/33 R |
| 3,849,860 | 11/1974 | Zahn et al. | 29/564.6 |
| 3,986,470 | 10/1976 | Berry et al. | 72/339 |
| 4,290,178 | 9/1981 | Friese | 29/564.6 |
| 4,545,233 | 10/1985 | Peddinghaus | 72/404 |
| 4,708,009 | 11/1987 | Post | 72/404 |
| 5,216,913 | 6/1993 | Post | 72/446 |
| 5,384,945 | 1/1995 | Spingler | 29/33 R |

FOREIGN PATENT DOCUMENTS

| | | | |
|---|---|---|---|
| 848120 | 7/1981 | U.S.S.R. | 72/404 |
| 2046402 | 6/1981 | United Kingdom | 72/404 |

*Primary Examiner*—Daniel W. Howell
*Assistant Examiner*—Christopher Kirkman
*Attorney, Agent, or Firm*—Haugen & Nikolai, PA

[57] ABSTRACT

Automated forming apparatus including a horizontal feed-belt and an overlying gantry containing a number of tool heads for forming alphanumeric trim pieces for sign letters. A number of laterally and vertically controlled tool heads are indexed to the feedbelt and operative per programmed micro-instructions to clamp, bend and cut a spooled trim material to define an alphanumeric shape. One or more formed trim pieces are fitted to a flat panel that is separately formed to a corresponding alphanumeric shape to define a letter which can be used alone or as a cover to a mating canister.

11 Claims, 15 Drawing Sheets

APPARATUS AND METHOD FOR FABRICATING TRIMMED LETTERS

BACKGROUND OF THE INVENTION

The present invention relates to trimmed sign letters and, in particular, to automated assembly equipment for constructing the trims for the letter covers and to the method of constructing the covers.

Varieties of sign letters and mounting systems are known for mounting letters of varying sizes to a support surface, such as a signboard, wallboard or billboard. Some systems directly mount the letters to the exterior side of a building.

Letters of one lettering system provide covers which mount to metal or plastic canisters having corresponding alphanumeric shapes. Letters of the latter type are sold by the present assignee, Gemini, Inc. under the tradenames TRIMCAP and GEMLITE and include plastic covers and canisters.

An integral component of the above letter systems is the detachable cover, which is trimmed with a metallic accent strip. For the one system, the covers mount to an injection molded, plastic canister that can be fitted with an illumination source of a corresponding shape. The cover typically provides a flat center panel and the accent trim is fitted to interior or exterior cut peripheral edges at the panel. The accent trim extends around the sides of the cover to shelter and form a weathertight joint with the supporting canister. For the other system, one or more support feet are mounted to the flat panel portion of the covers to facilitate adhesive attachment of only the covers to a planar support substrate.

Previously, the letter covers included hand fitted accent trims having a metal finished inlay. The stock was hand cut, notched, and bent before being fitted and bonded to the exposed edges of a letter panel. The trims and panels were constructed from a variety of colored metal laminates and acrylic panel pieces.

An inherent problem with the construction of the foregoing letters was the necessity to custom fabricate each trimmed cover. Although the flat panels and supporting canisters are constructed using conventional forming and molding processes, the construction of each cover requires appreciable amounts of manual labor and time.

That is, each trim piece is hand fitted to the panel piece of each cover. Each trim piece is created by cutting a number of notches at appropriate surfaces and locations of the trim stock. The trim stock is then bent at the notches to obtain necessary inside and outside curves and bends for each letter. The prepared trim pieces are fitted to the peripheral edges of the panel piece, clamped and adhesively bonded to the panel piece.

The subject invention was developed to provide an automated tool capable of forming trim pieces for any desired alphanumeric character without the necessity of notching the trim stock. Assembly equipment is particularly provided having a number of suspended tool heads which automatically advance a spooled length of trim stock past the tool heads and appropriately clamp, bend and cut the trim stock. A clamped support and drive motor contain and advance the trim stock as the tool heads engage the stock to obtain desired bends and curves. A conveyor belt receives the finished trim pieces. The equipment is programmable to properly direct the advancement of the stock, conveyor belt and motion of the individual tool heads.

SUMMARY OF THE INVENTION

It is accordingly a primary object of the invention to provide automated tooling for bending trim pieces for sign letters from an extruded stock into alphanumeric shapes complementary to a supporting panel piece.

It is a further object of the invention to sequentially advance a spooled trim material on edge between a supporting rail and clamp assembly past a work station accessible to an overlying gantry containing a number of tool heads.

It is a further object of the invention to provide a screw follower drive to a carriage at the gantry for laterally manipulating the tool heads.

It is a further object of the invention to provide a microprocessor controller for sequentially advancing, clamping, bending and cutting the trim stock to match the panel piece.

It is a further object of the invention to provide a conveyor belt for receiving and advancing the formed trim pieces to maintain an unobstructed work area.

Various of the foregoing objects, advantages and distinctions of the invention are obtained in a presently preferred assembly which includes a horizontal conveyor belt and an overlying gantry that supports a number of laterally and vertically directable tool heads. A tool head carriage and tool heads are indexed and operated relative to a number of limit switches. The tool heads variously roll form inside and outside bends and curves and cut the formed material.

A controller includes programmed micro-instructions to direct electro-mechanical servos and associated pneumatic motors at the gantry carriage and tool heads and also the operation of a conveyor motor, a material feed motor and a clamp assembly. With the final forming of each trim piece, the material is cut to length and butt joined. A splice piece is adhesively bonded to an interior surface of the trim to overlap the butt joint.

Depending upon the alphanumeric character, one or more trim pieces as separately fitted and adhesively bonded to each panel piece. The alphanumeric letters can be used alone or as covers for associated canisters.

Still other objects, advantages and distinctions of the invention will become more apparent upon reference to the following description with respect to the appended drawings. To the extent various modifications and improvements have been considered, they are described as appropriate. The description therefore should not be strictly construed in limitation of the invention. Rather, the invention should be interpreted within the scope of the further appended claims.

FIGS. *6a–6f* show an exemplary alphanumeric letter set adapted to the invention.

Figure 7:
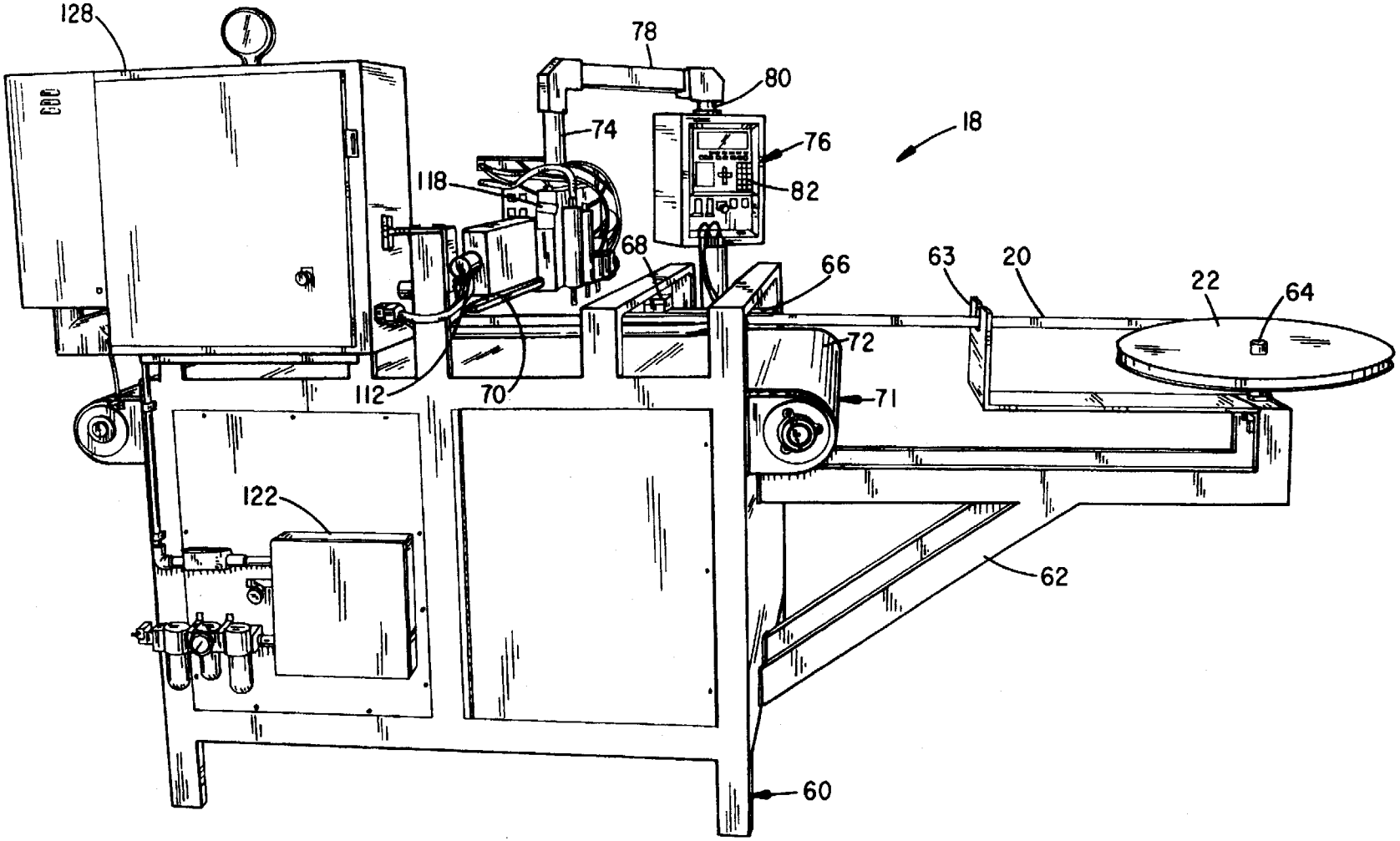

FIG. 7 is a perspective drawing showing the trim piece forming assembly of the invention.

Figure 8:
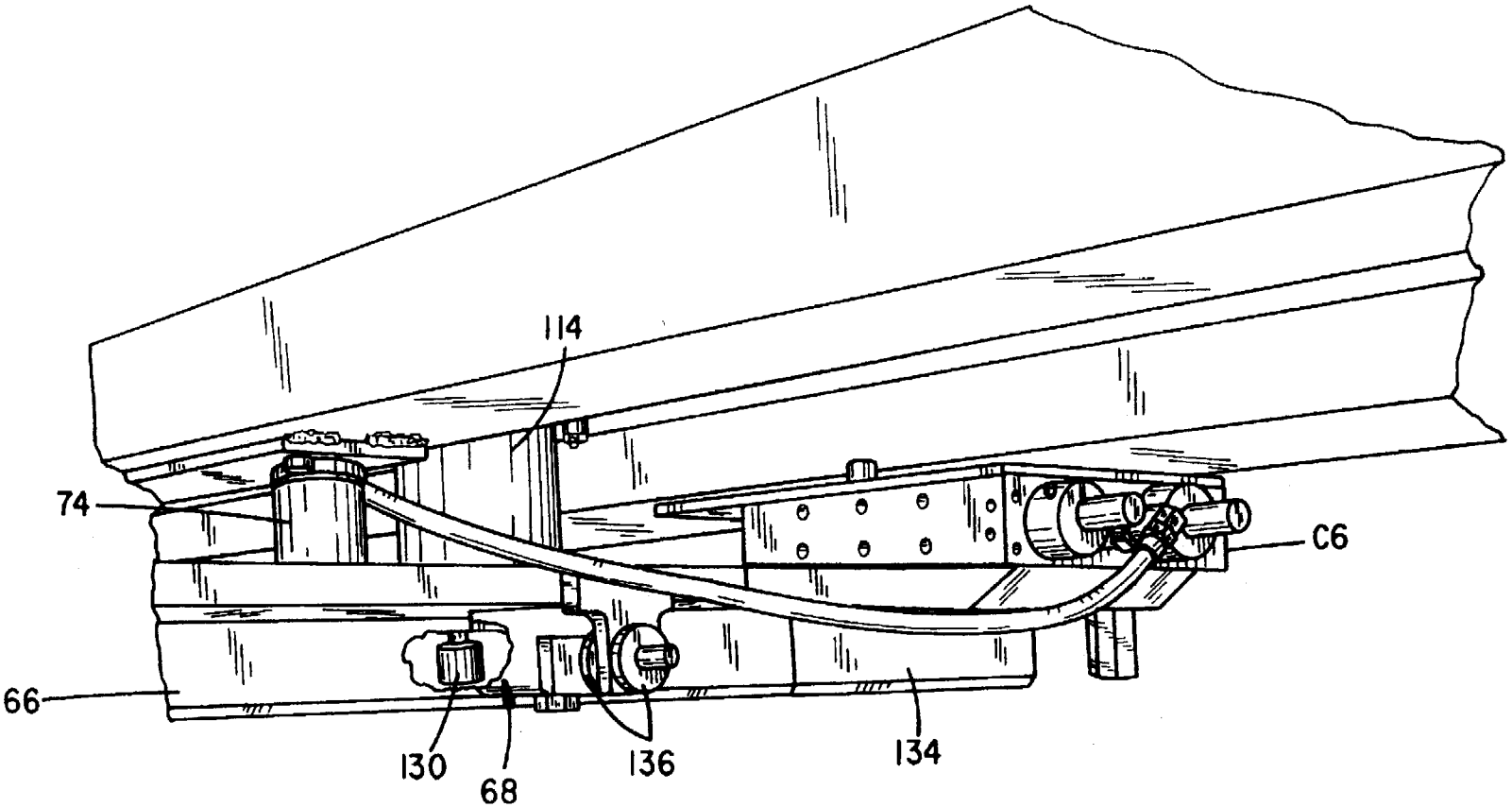

FIG. 8 is a perspective drawing showing the trim stock clamp and feed assemblies.

Figure 9:
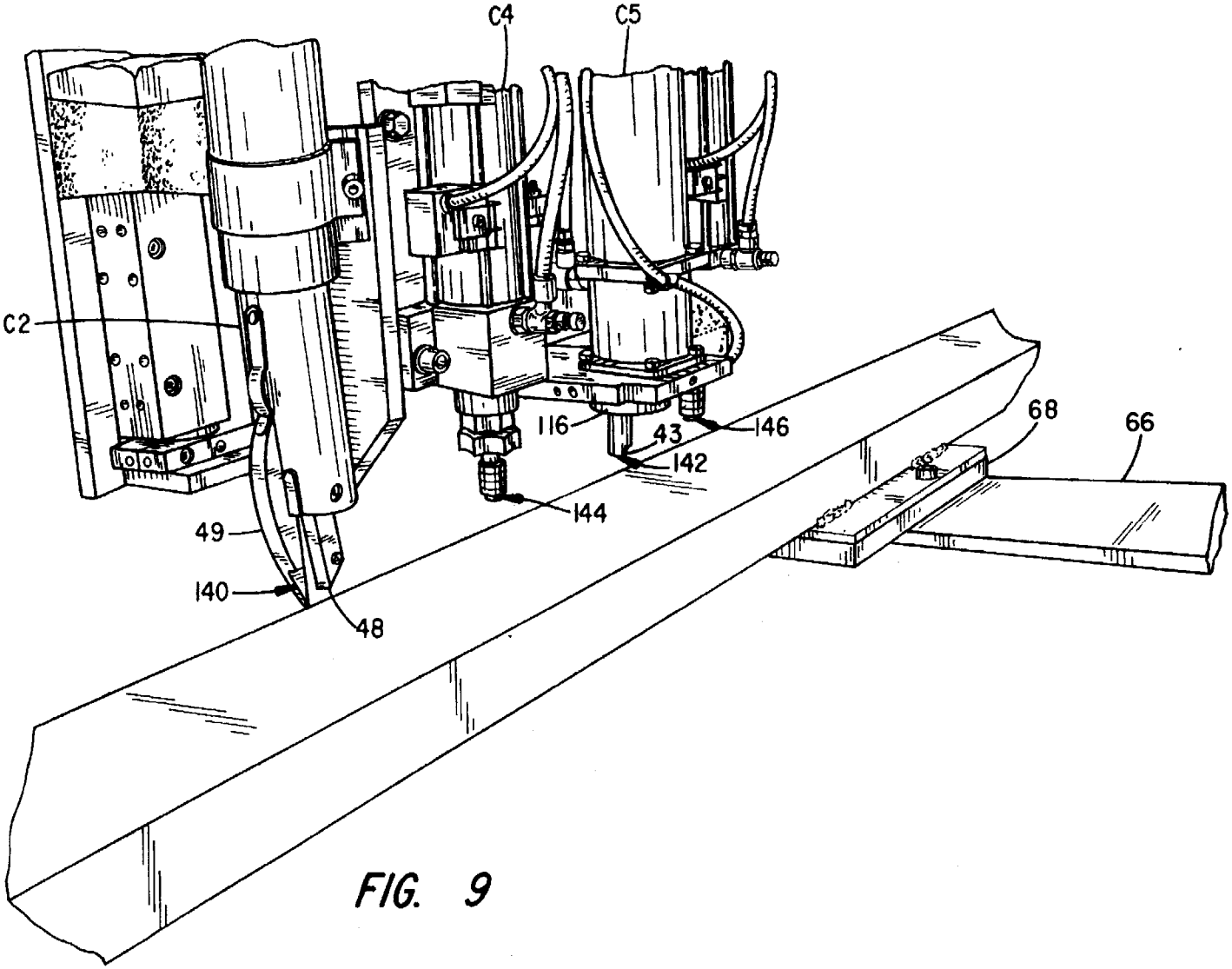

FIG. 9 is a perspective drawing showing the gantry mounted tool heads.

Figure 10:
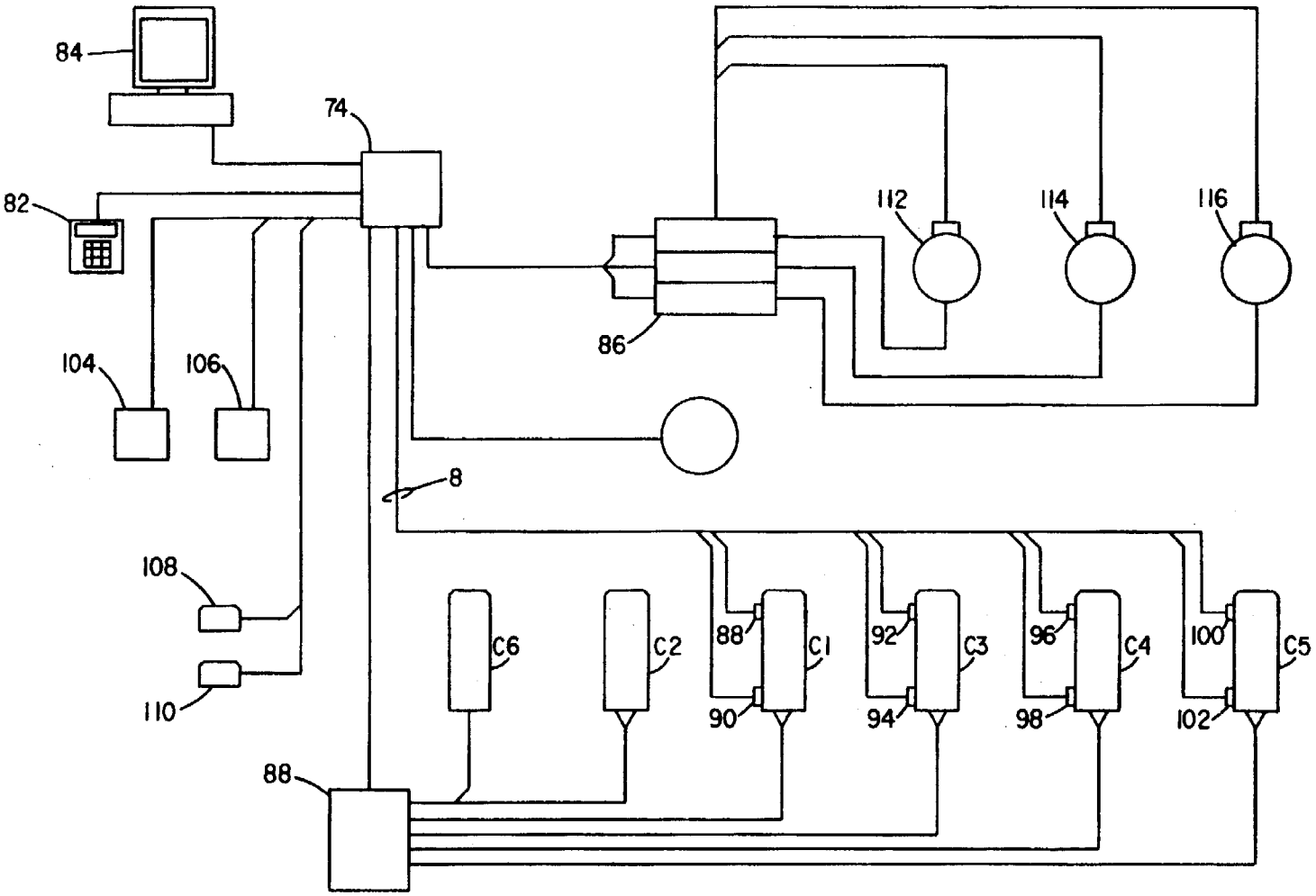

FIG. 10 is a control diagram of the electro-mechanical control of the forming assembly.

DESCRIPTION OF THE PREFERRED EMBODIMENT

Figure 1:
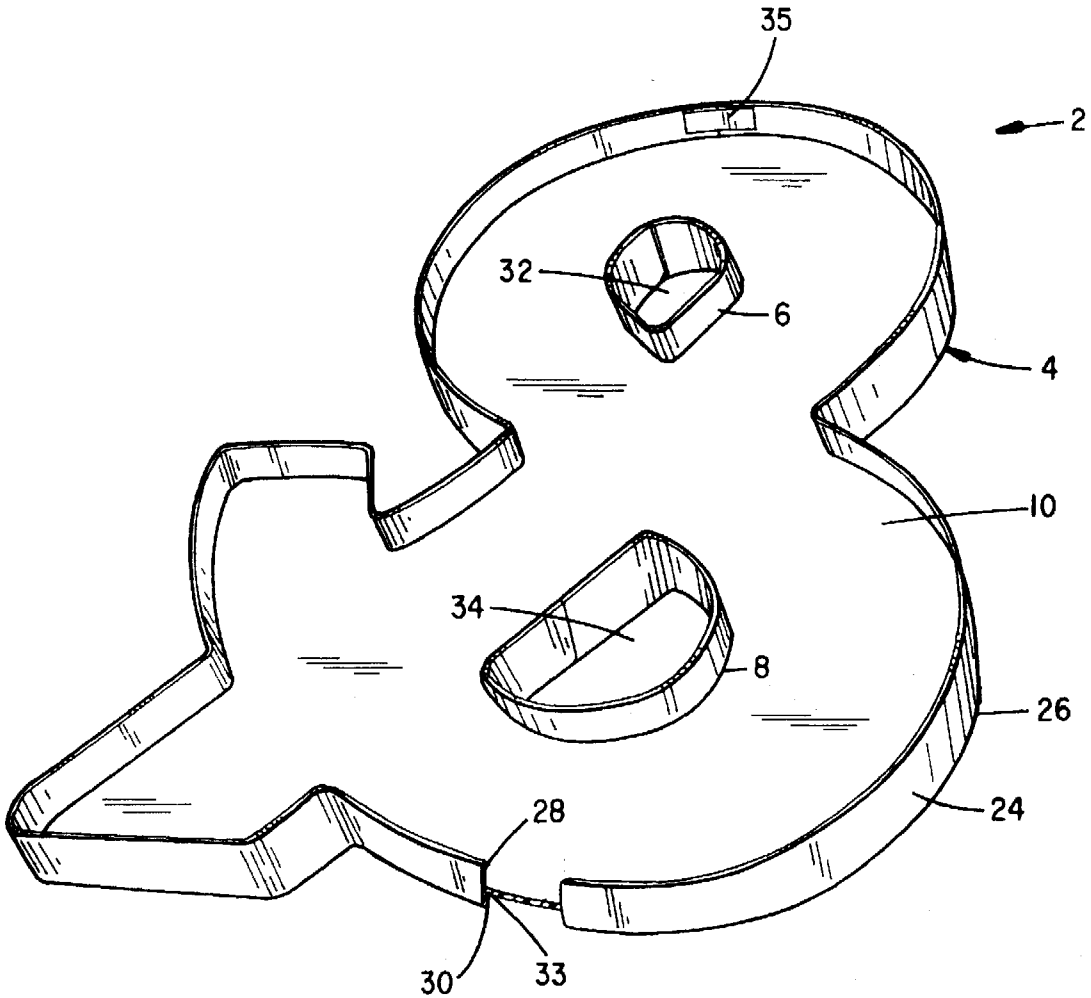
FIG. 1 is a perspective drawing of an exemplary, trimmed ampersand "&" cover constructed with the fabrication equipment of the invention.
Figure 2:
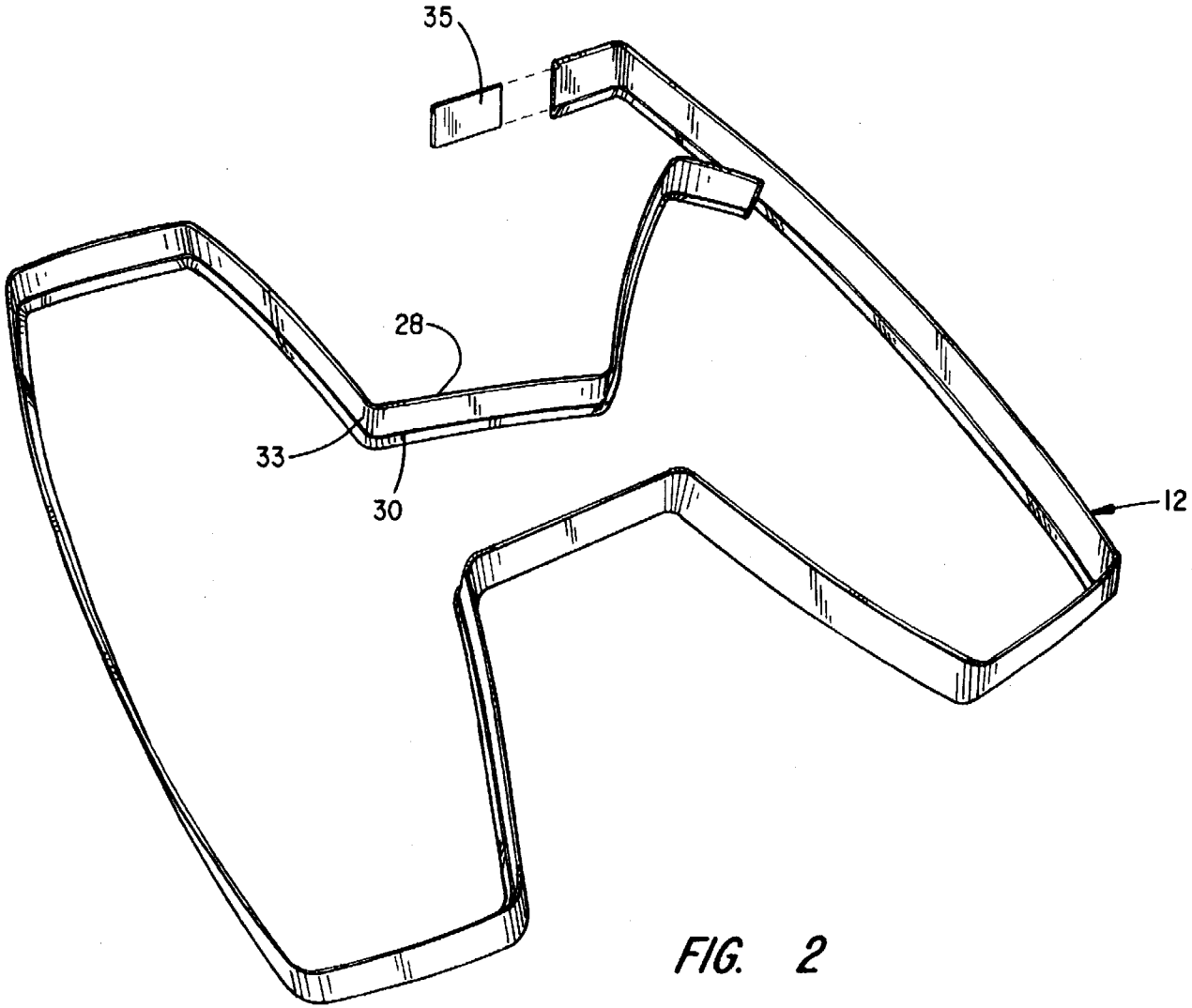
FIG. 2 is a perspective drawing of a formed trim piece for the letter "H" as it appears before bonding to a center panel.
Figure 3:
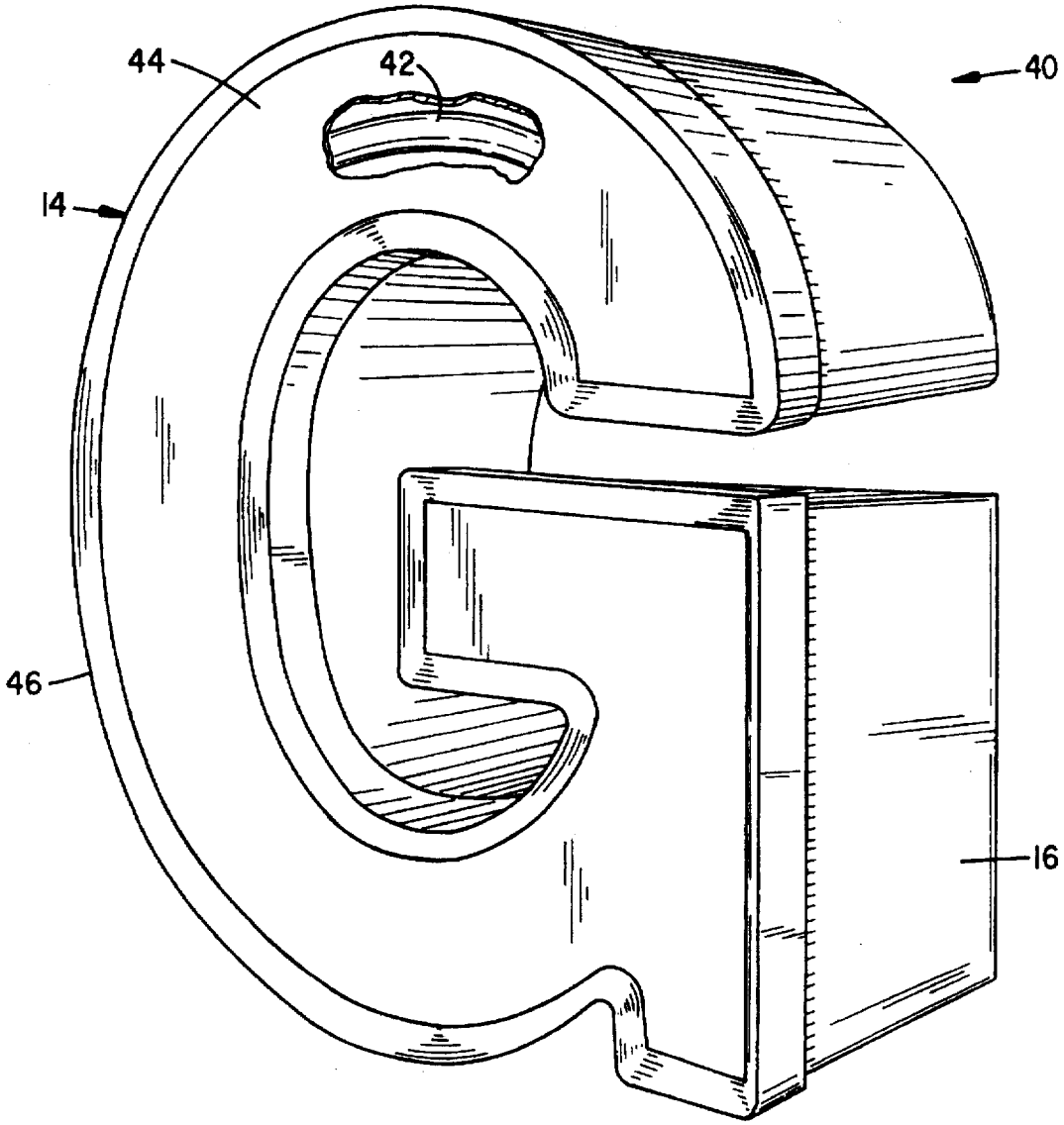
FIG. 3 is a perspective drawing of a sign letter "G", which includes a trimmed cover fitted to an illuminated cannister.

Referring to FIG. 1, a cover 2 is shown for an exemplary alphanumeric character or ampersand "&". The cover consists of a number of trim pieces 4, 6 and 8 which are fitted to a center panel 10. A partially formed trim piece 12 for a cover of the letter "H" and a completed cover 14 and support canister 16 for the letter "G" are respectively shown at FIGS. 2 through 4. The covers for a set of related Helvetica letters are shown at FIGS. 6*a* through 6*f*.

The trim pieces 4 and 12 are constructed with the automatic forming assembly 18 of the invention, which is shown generally at FIG. 7. FIGS. 8 through 10 disclose particular details to the tool heads, drive assembly and electro-mechanical controller of the forming assembly 18. The assembly 18 is capable of forming trims for any alphanumeric character or other contoured design.

The cover trims are shaped from an extruded plastic trim stock 20 that is fed from a spool 22. The trim stock 20 can exhibit a variety of on-edge profiles and can be obtained in a number of different colors and materials. The trim stock 20, reference FIG. 1, particularly includes a metal finished band 24 which is inlet at a grooved recess 26 provided between roll formed edges 28 and 30. The band 24 can be laminated or secured by a variety of techniques to a base substrate of the stock 20.

Once formed to shape, the trims 4, 6 and 8 are fitted to the interior and exterior peripheral edges of the center panel 10. The panel 10 is typically formed from an acrylic plastic that is die cut to a preferred shape. The panel 10 can be opaque or transparent.

Where interior apertures 32 and 34 are included, such as at the cover 2, the complementary trim pieces 6 and 8 are also fitted to the peripheral edges of the apertures 32 and 34. The trim pieces 4, 6 and 8 are adhesively bonded to the panel 10 in alignment with an interior surface 33 at the roll formed edge 30. The trim 4 can thus overlap the mating canister 16, reference FIGS. 3 and 4, upon mounting the cover 2 to the canister 16. With the fitting of each trim piece 4, 6 and 8 to the panel 10, a short splice piece 35 is also adhesively bonded to the interior surface 33 of each trim to span the butt fitted ends.

Each of the trims 4, 6 and 8 requires a number of acute and obtuse bends and/or gradual intervening sweeping curves between the bends. In contrast, the "H" shaped trim piece 12 only requires a number of inside and outside 90 degree bends. The latter bends are formed at 105 degrees to accommodate a slight relaxation of the trim piece 26 after forming.

The forming assembly 18 therefore accommodates a variety of bends and curves which are automatically formed as required for each alphanumeric character in response to pre-programmed drive instructions. The drive instructions control associated servos and motors at the assembly 18. The specific type and location of each bend is particularly varied in relation to the character, point size, font type and the dimensions of the character. The specific location of each bend and the sequence of operations are programmed into the forming assembly 18 and are made without the necessity of notching the trim stock 20. Prior hand forming techniques, required that all bends be formed with notches, which were separately measured and cut, prior to hand forming each bend and curve of each trim piece.

Figure 5:
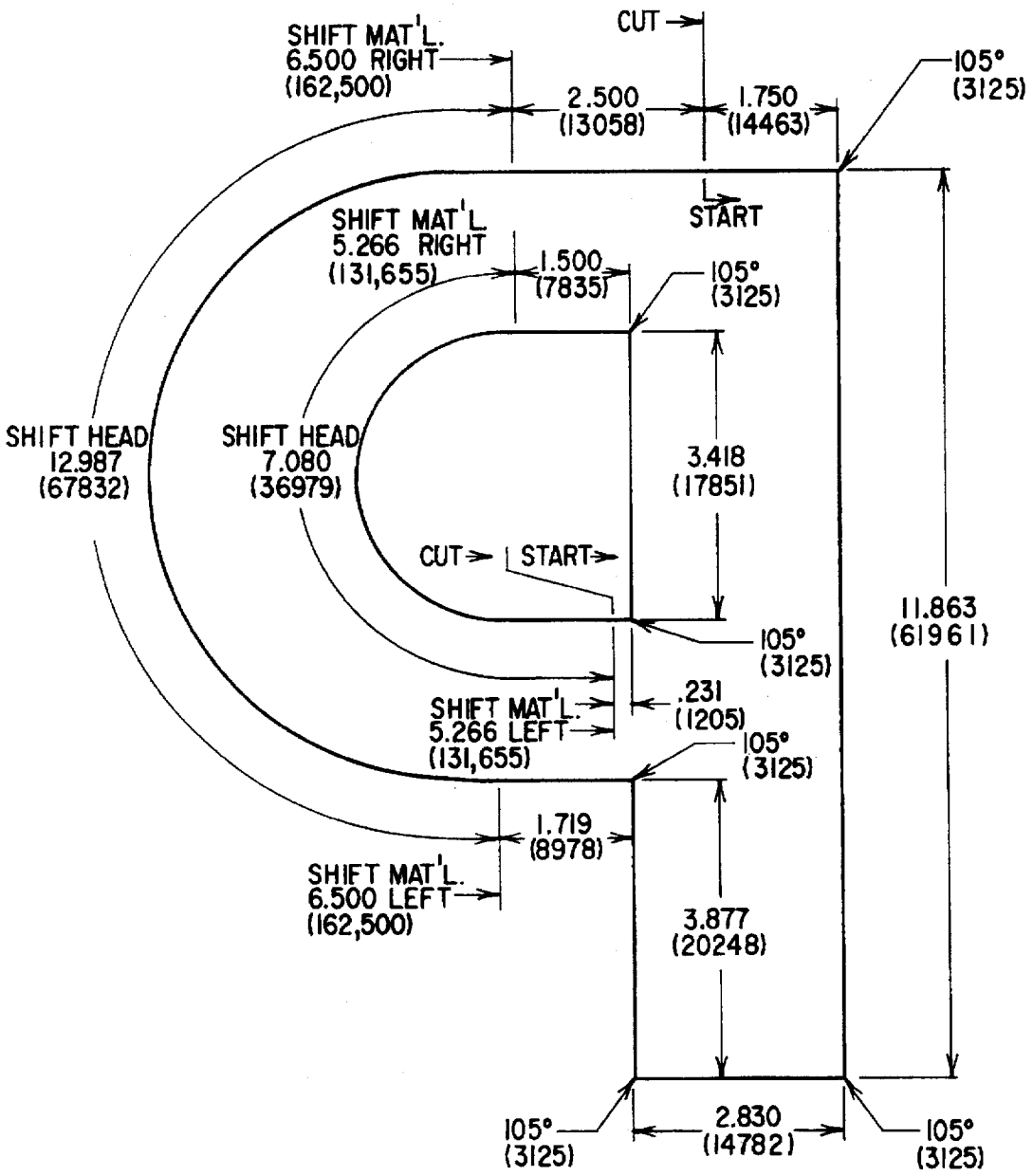
FIG. 5 is a drawing to a letter "P" and an exemplary sequence of forming steps which are performed to form the trim pieces for the letter.
Figure 6A:
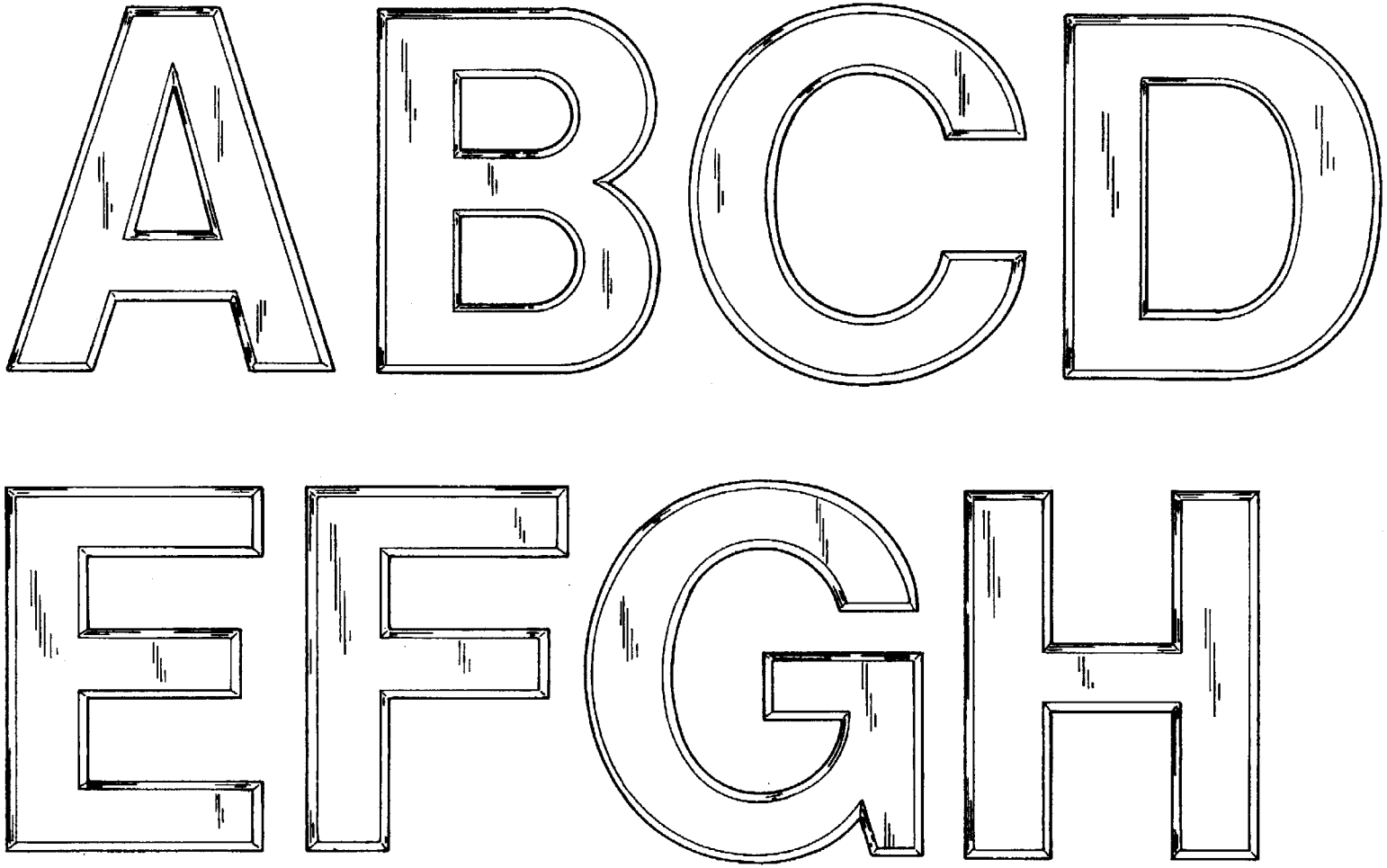
Figure 6B:
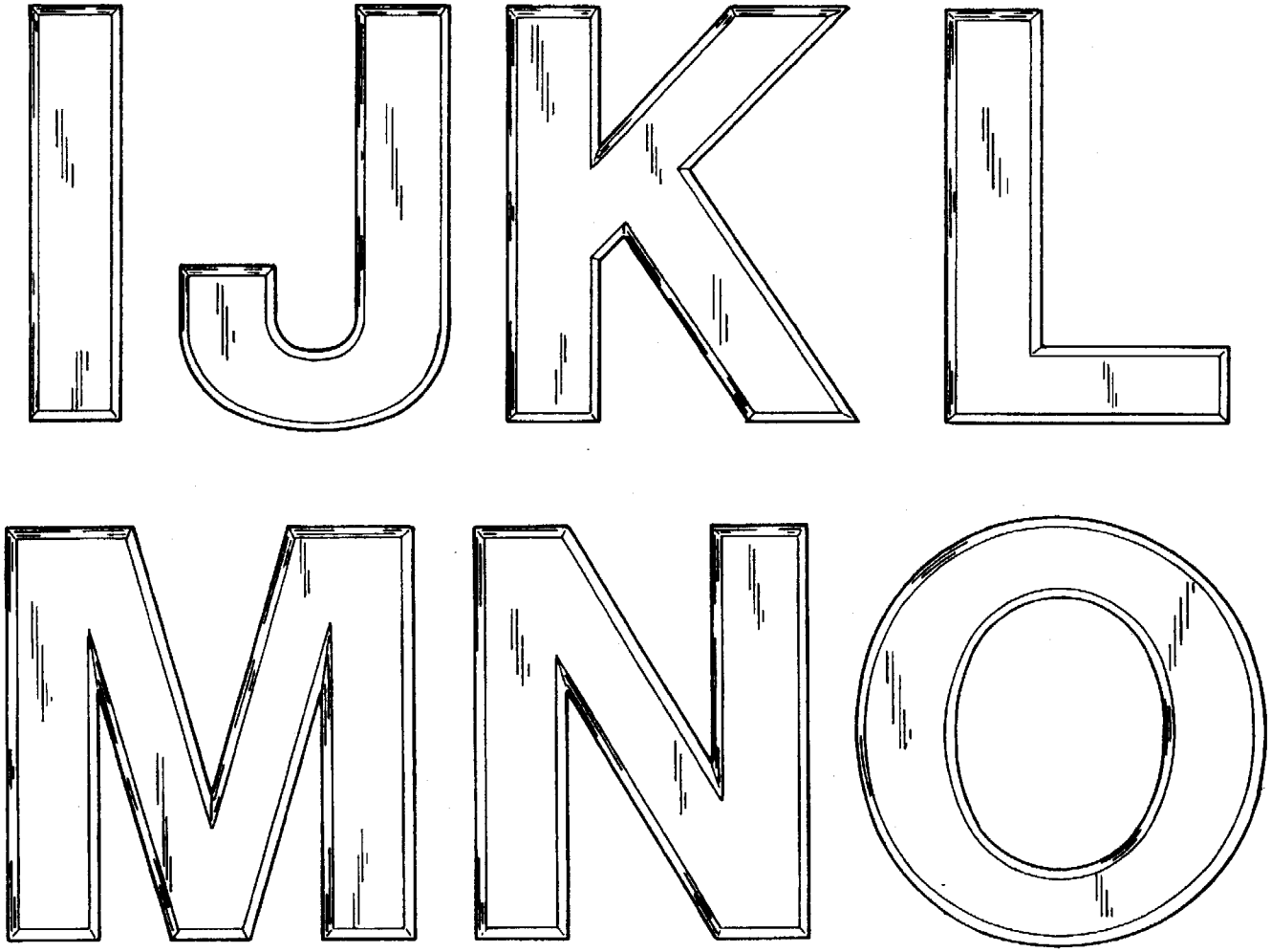
Figure 6C:
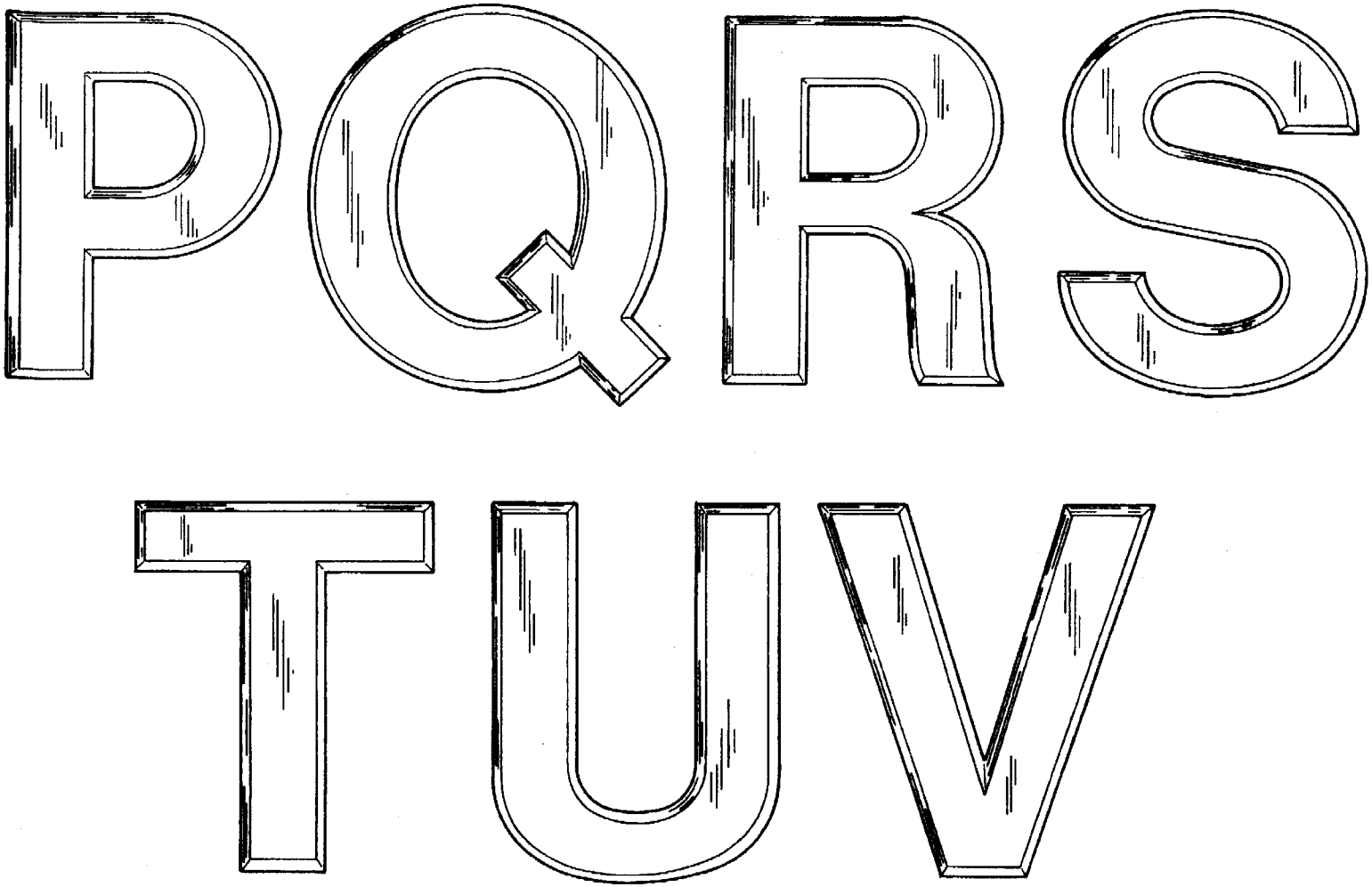
Figure 6D:
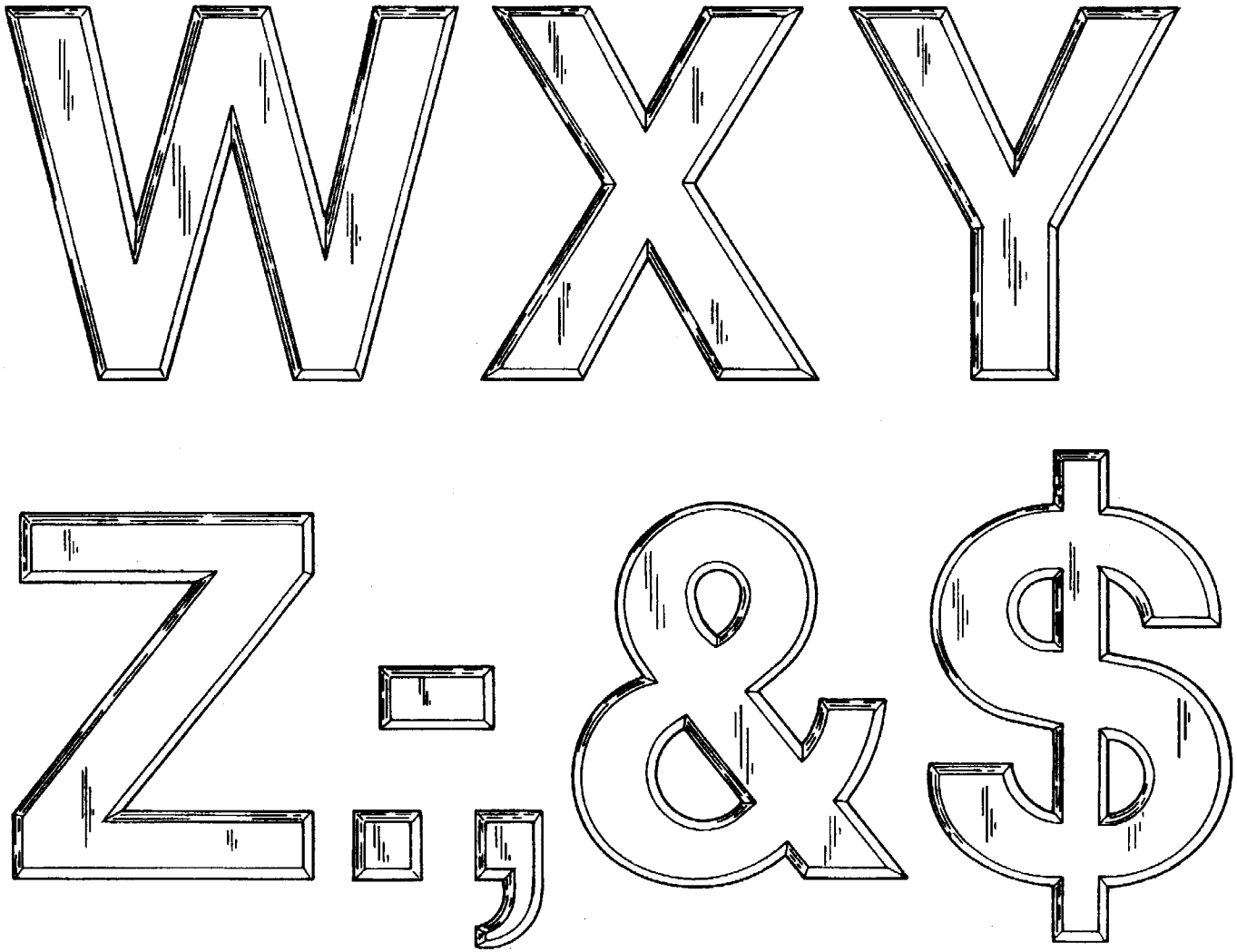
Figure 6E:
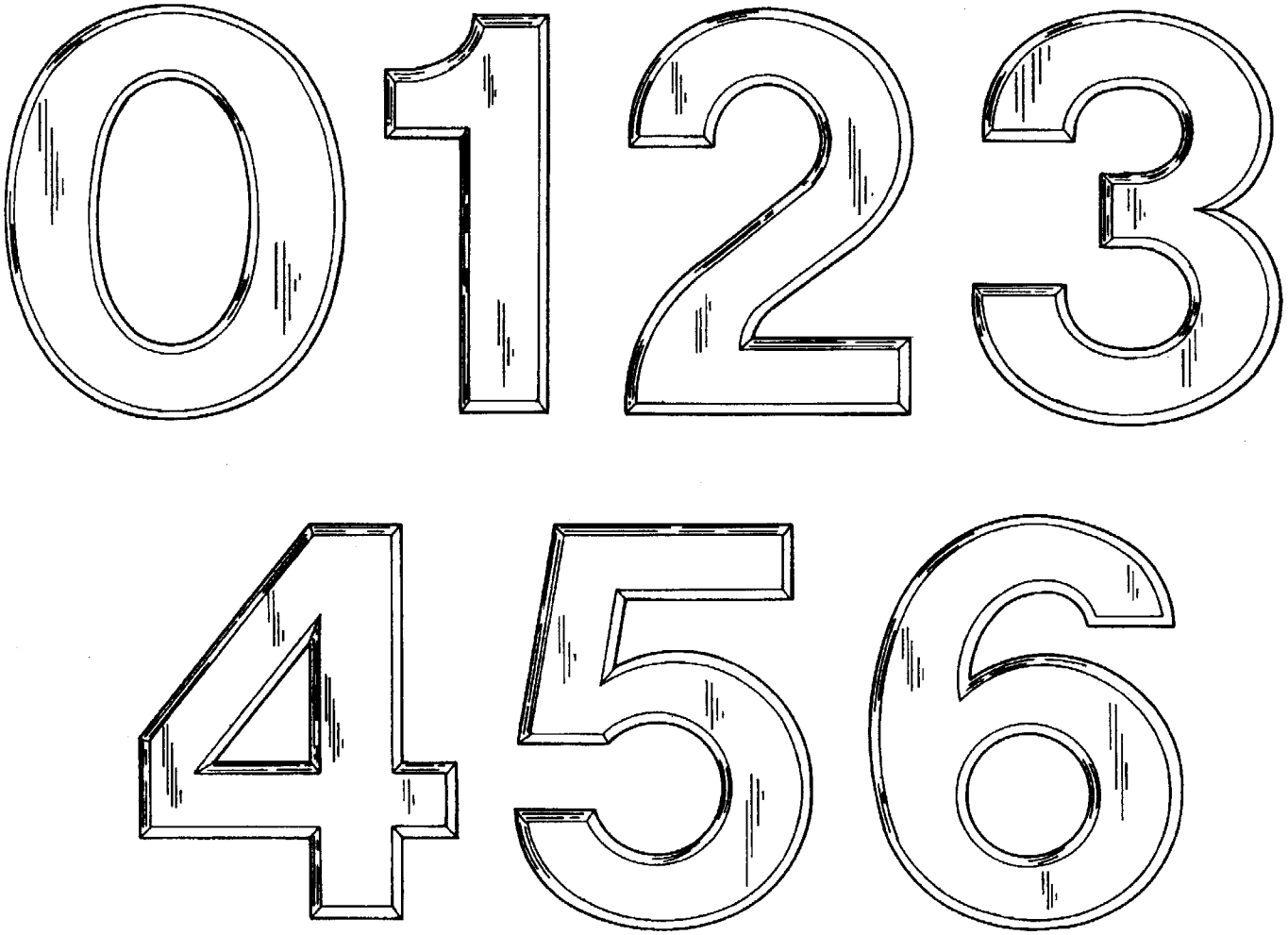
Figure 6F:
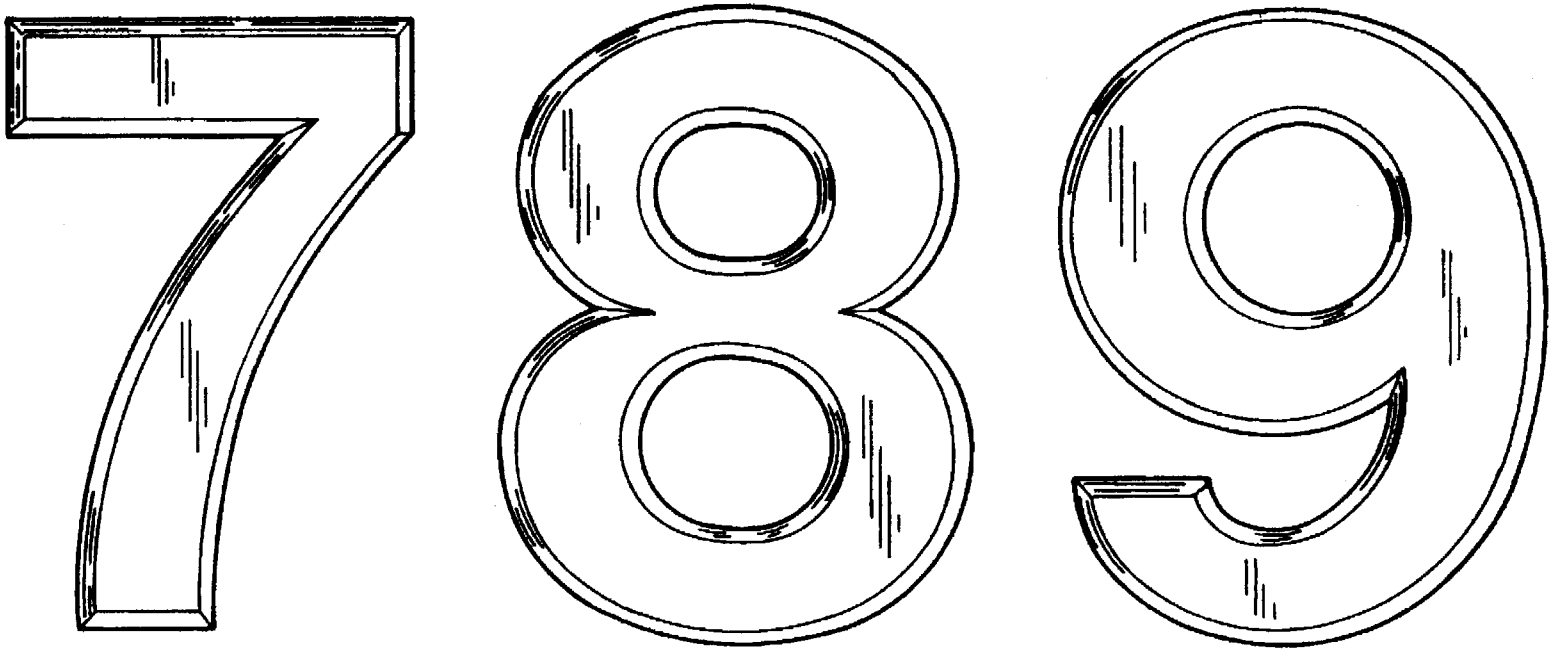

A sequence of operations and the locations of each are shown for an exemplary letter "P" at FIG. 5. The dimensional distances and motor drive pulses supplied to the material drive motor, gantry carriage motor and ninety degree forming head of the assembly 18 necessary to achieve proper forming are particularly noted and the significance of which is more apparent from the following description.

Returning attention first, however, to FIGS. 3 and 4, a complete letter 40 or the letter "G" is shown, which is constructed from the trimmed, transparent cover 14, and which is fitted to the opaque plastic canister 16. The canister 16 is illuminated with a formed neon lamp 42 (shown in cutaway) that is supported within the canister 16. Electrical couplers (not shown) are fitted to openings cut into the back of the canister 16 and couple a source of AC voltage to the lamp 42. The light from the lamp 42 passes through a transparent center panel 44 bordered by a trim 46. The canister 16 might also be used without a lamp 42, if illumination is not required.

Figure 4:
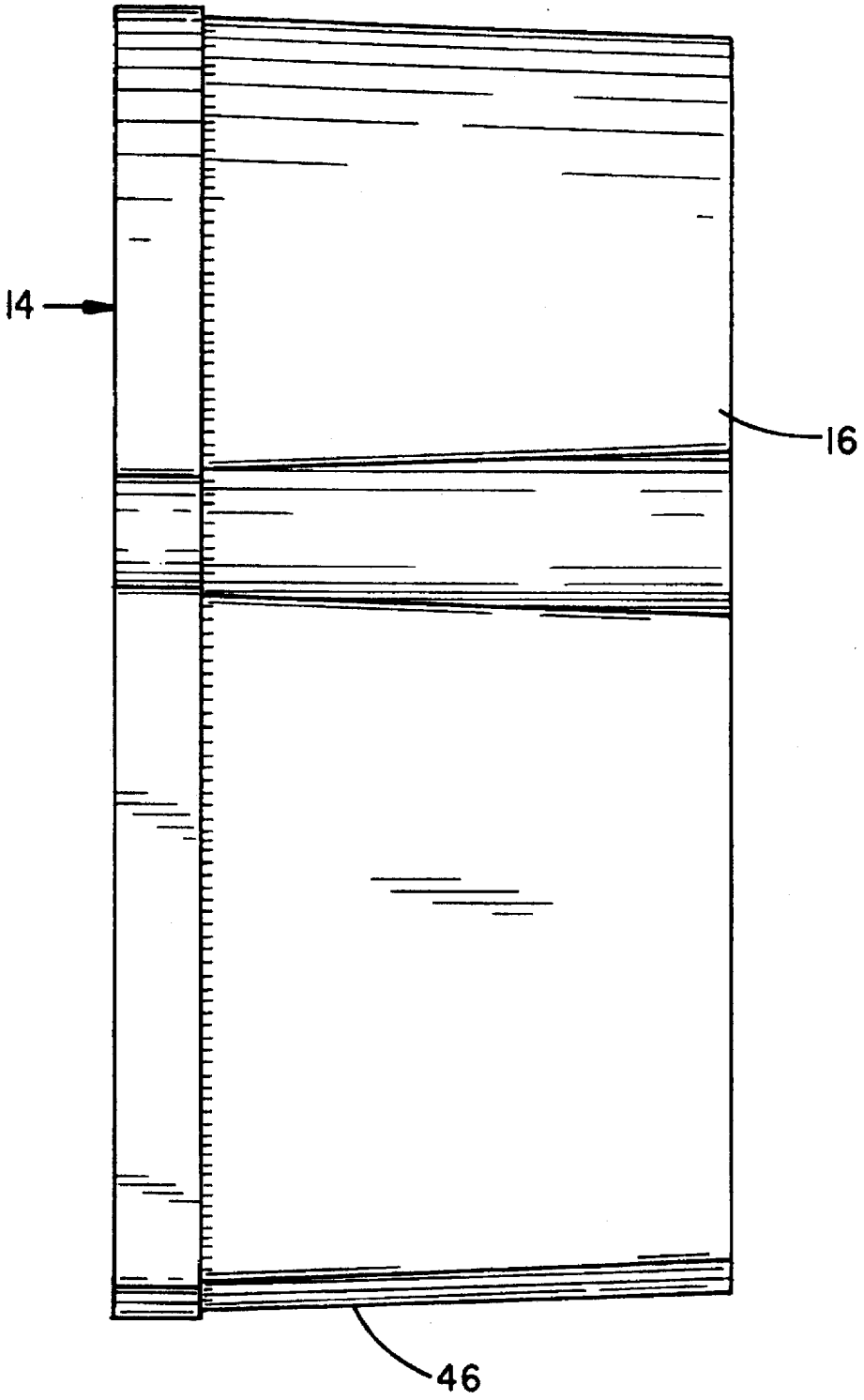
FIG. 4 is a side elevation view showing the tapered draft of each canister and the overlapped fit of the cover.

The canister 16 also provides a tapered draft 46, reference FIG. 4, which assures that any water that enters the letter 40 is drained toward the cover 14. The side walls of the cover 14 overlap the canister 16 to protect the seam from most weather, yet permit any collected water to drain.

A variety of other letters and numeric characters of a set including the letter 40 are shown at FIGS. 6*a* through 6*f*. The illuminated letters of FIGS. 6*a*–6*f* are used in a variety of outdoor sign applications.

The covers 4 and 14 can also be used without a cannister 16. For such covers, pedestal feet of conventional construction (not shown) are typically bonded to the back of the panels 10 and 44.

Turning attention to FIGS. 7 through 10, the trim forming assembly 18 is constructed about a support frame 60 and from one end of which a wing frame 62 extends. An axle 64 projects from the wing frame 62 to support the spool 22 of trim material 20. The material 20 is fed through a feed guide 63 and supported on-edge from a guide track 66 which is longitudinally aligned to a pneumatic clamp assembly 68. The clamp assembly 68 is positioned below a gantry 70 that supports a number of tool heads at a work position.

The tool heads can be laterally and vertically manipulated to engage the trim stock 20. The clamp assembly 68 is positioned above a motorized conveyor assembly 71 and conveyor belt 72. The belt 72 supports the formed stock during processing and directs each finished trim piece away from the work station and to the next assembly station, once formed.

Mounted slightly forward of the clamp assembly 68 and to one side of the gantry 70 is a rotating support column 74. An operator control panel or controller 76 is mounted to the column 74. The controller 76 is typically programmed by a machine operator via a keyboard 78 to control a number of electro-mechanical servos fitted to the frame 60 and which control the movements of the tool heads and the gantry 70. A computer 84, reference FIG. 10, interfaced to the controller 76 may also be used to program the controller 76. FIG. 10 depicts a schematic diagram to the controller 76, electro-mechanical servos and motors at the assembly 18.

Pulsed control signals are coupled from the controller 76 to a conveyor motor M1, a motor drive interface 86, and a pneumatic solenoid controller 88 which operates a number of pneumatic cylinders in response to the programmed instructions. In addition to the programmed data, the controller 76 responds to inputs from a number of limit switches that detect movement of cylinders C1, C3, C4 and C5 at various of the tool heads and the gantry 70. Limit switches 88,90; 92,94; 96,98; and 100,102 respectively monitor motion of the cutter carrier cylinder C1, the ninety degree bend or Z-axis motor carrier cylinder C3, the right curve cylinder C4, and the left curve cylinder C5. Switches 104 and 106 establish the "X-axis" and "Z-axis" home positions and switches 108 and 110 determine left and right limits of X-axis motion at the gantry 70. Motion is not monitored at the clamp cylinder C6 or the cutter cylinder C2.

The controller 76 provides pulsed drive signals to the motor M1, an "X-axis" carriage motor 112 at the gantry 70, a "Y-axis" material feed motor 114, and a "Z-axis" bend motor 116. The motors 112–116 respectively control movement of the conveyor belt 72, a tool head carriage 118 at the gantry 70, the trim stock 20, and rotation of the tool head that forms ninety degree bends. The various motors 112–116, pneumatic cylinders C1–C6 and wiring shown at FIG. 10 are contained at cabinets 120 and 122 and other supports fitted about the frame 60.

As mentioned, the tool heads are supported to the carriage 118 at the gantry 70. A screw follower carriage 118 is particularly provided which responds to the motor 112. Upon driving the carriage motor 112 with appropriate pulse modulated drive signals, each tool head at the carriage 118 can be laterally manipulated into alignment with the trim material 20 immediately forward of the clamp assembly 68. Vertical motion of the individual tool heads is separately controlled with the pneumatic cylinders C1 through C5. The cylinder C6 separately controls the clamp assembly 32.

All "X", "Y" and "Z" motions are programmed to occur at defined distances or numbers of pulses as the trim stock 20 is fed through the clamp 68. Which tool head is manipulated into alignment with the material 20 for any given operation depends upon the character being formed. The up/down limit switches at each tool head assure proper alignment of each tool head to the trim stock 20. FIG. 5 depicts a programmed sequence which is performed during the forming of the trim pieces for a 12 inch letter "P" and for which both lineal measures and pulse counts are sequentially shown for each operation point.

As the trim material 20 is formed to shape, the formed trim pieces fall to the conveyor belt 72, which is advanced as necessary to clear the material from the working area of the tool heads. Once completed, each trim piece is conveyed to the off-feed end of the assembly 18, where an operator extracts the trim or the trim is collected with a basket or other appropriate pickup tool (not shown).

Turning attention to FIG. 8, details are shown to the trim stock drive motor 114 and the clamp assembly 68. The drive motor 114 is pulsed to rotate a knurled drive wheel 130 which contacts and advances the trim material 20. The knurled wheel 130 contacts one side of the material 20 as a spring biased idler wheel (not shown) contacts the other side of the material 20.

The pneumatic clamp assembly 68, in turn, provides a presser foot or clamp plate 134 which is mounted to one side of the guide rail 66. The forward end of the clamp plate 134 is mounted approximately ⅛ inch from the work station beneath the tool heads. The cylinder C6 controls the motion of the clamp plate 134.

A pair of adjustment screws 136 fix the separation of the clamp plate 134 from the rail 66. The pressure at the clamp plate 134 is suitably adjusted to prevent marring the material 20. With the release of the clamp plate 134, the motor 114 advances the material 20 as required for each forming step.

With attention to FIG. 9, a detailed view is shown to the cutter 140 and the forming tool heads 142, 144, and 146. Ninety degree bends are achieved with the flat faced tool head 142 and the motor 116. The surface 148 of the tool head 142 is cut to complement the edge profile of the material 20 and provide a flat surface. Upon butting the surface 148 to the material 20, which is held stationary at the clamp 68, and rotating the tool head 142 either clockwise or counter clockwise via the motor 116, the material 20 is bent to shape. Nominal 90 degree bends are formed by bending the material 105 degrees, which upon release relaxes to the desired 90 degrees.

Arcuate curvatures are formed by contacting and feeding the trim material 20 past one of the right or left hand roller tool heads 144 and 146. Depending upon the curvature, one of the tool heads 144, 146 engages one side of the material 20. The tool head 144 or 146 is then laterally shifted at a controlled rate as the material 20 is advanced by the feed motor 114 and a corresponding right or left curvature is formed in the material. The curvature is a function of the relative movement of the material and carriage 118. A heater might also be provided to facilitate the forming of curves.

Upon completing all necessary forming operations, the shear or cutter tool head 148 is vertically directed as appropriate to cut the formed material 20 to a determined length. With the centering of the material 20 between jaws 150, 152 and extending the cylinder C2, the material 20 is cut.

While the invention has been described with respect to a preferred construction, still other constructions may be suggested to those skilled in the art. The foregoing description should therefore be construed to all those embodiments within the spirit and scope of the following claims.

What is claimed is:

1. Apparatus for forming trimmed letters comprising:

a) a spool of trim material and means for supporting said trim material on edge above a conveyor belt;

b) a carriage mounted to a framework above said conveyor belt and supporting a plurality of tool heads, wherein said tool heads project to contact said trim material, and wherein one of said tool heads includes a shearing edge, wherein one of said tool heads includes a deforming cylindrical roller edge, and wherein one of said tool heads includes a deforming surface which exhibits a flat profile complementary to a shape of said trim material;

c) drive means for longitudinally advancing said trim material;

d) clamp means for restraining movement of said trim material;

e) carriage means for laterally shifting said plurality of tool heads; and f) control means coupled to said drive, clamp and carriage means for progressively advancing and clamping said trim material and for acting on said material with said tool heads to form a plurality of bends therein matching a peripheral edge of an alphanumeric character.

2. Apparatus as set forth in claim 1 wherein said carriage is mounted to a lead screw and wherein said carriage means includes a motor for laterally advancing and retracting said tool heads relative to the trim material.

3. Apparatus as set forth in claim 2 wherein each of said tool heads is supported from means for raising and lowering each of said tool heads into engagement with the trim material.

4. Apparatus as set forth in claim 3 wherein said trim material is supported to a longitudinal rail and wherein a presser foot of said clamp means is operative to compress said trim material between said presser foot and rail.

5. Apparatus as set forth in claim 4 wherein said drive means comprises a knurled drive head supported from a drive motor, which head is mounted to contact one surface of said trim material, and an idler roller mounted to contact an opposite surface of said trim material.

6. Apparatus as set forth in claim 4 wherein one of said tool heads comprises a shear having first and second jaws, which jaws are mounted to cut the trim material upon lowering the shear onto the material.

7. Apparatus as set forth in claim 4 including a framework supporting an endless conveyor belt and means for rotating the conveyor belt.

8. Apparatus as set forth in claim 1 including switch means for limiting the range of motion of said carriage and each of said tool heads which form bends into said trim material and for defining a home position for said carriage and a home position for at least one of the bend forming tool heads.

9. Apparatus for forming trimmed letters comprising:

a) a framework supporting an endless conveyor belt and means for rotating the conveyor belt;

b) a spool of trim material;

c) a longitudinal rail and a presser foot of a clamp means for compressing said trim material between said presser foot and rail;

c) a carriage mounted to a lead screw and including a motor for laterally advancing and retracting a plurality of tool heads above said conveyor belt, wherein each of said tool heads is supported from means for raising and lowering each of said tool heads into engagement with the trim material, and wherein one of said tool heads includes a shearing edge, wherein one of said tool heads includes a deforming cylindrical roller edge, and wherein one of said tool heads includes a deforming surface which exhibits a flat profile complementary to a shape of said trim material;

d) drive means for advancing said trim material; and e) control means means for progressive and clamp means for progressively advancing and clamping said trim material and for acting on said material with said tool heads to form a plurality of bends therein matching a peripheral edge of an alphanumeric character.

10. Apparatus as set forth in claim 9 wherein said drive means comprises a knurled drive head supported from a drive motor and contacting one surface of said trim material and an idler roller mounted to contact an opposite surface of said trim material.

11. Apparatus as set forth in claim 9 including switch means for limiting the range of motion of said carriage and each of said tool heads and defining a home position for said carriage and a home position for a ninety degree bending tool.

* * * * *